US007738825B2

(12) United States Patent
Ito

(10) Patent No.: US 7,738,825 B2
(45) Date of Patent: Jun. 15, 2010

(54) ENDLESS BELT HAVING DEFORMATION PREVENTION QUALITIES, AND IMAGE FORMING APPARATUS THAT USES THE ENDLESS BELT

(75) Inventor: Michiaki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 164 days.

(21) Appl. No.: 12/071,380

(22) Filed: Feb. 20, 2008

(65) Prior Publication Data

US 2008/0213011 A1 Sep. 4, 2008

(30) Foreign Application Priority Data

Feb. 21, 2007 (JP) ..... 2007-040501

(51) Int. Cl.
*G03G 15/00* (2006.01)
*G03G 15/14* (2006.01)

(52) U.S. Cl. ..... 399/313; 399/165; 399/303

(58) Field of Classification Search ..... 399/162, 399/165, 164, 303, 313, 302
See application file for complete search history.

(56) References Cited

U.S. PATENT DOCUMENTS

| | | | | |
|---|---|---|---|---|
| 5,017,969 | A * | 5/1991 | Mitomi et al. | 399/299 |
| 6,160,978 | A * | 12/2000 | Tsuruoka et al. | 399/165 |
| 6,816,691 | B2 * | 11/2004 | Kabata et al. | 399/165 |
| 6,928,256 | B2 * | 8/2005 | Matsuda et al. | 399/162 |
| 7,027,759 | B2 * | 4/2006 | Kabata et al. | 399/165 |
| 7,536,144 | B2 * | 5/2009 | Ohta | 399/302 |
| 2003/0206749 | A1 * | 11/2003 | Kashiwabara et al. | 399/302 |
| 2004/0076455 | A1 * | 4/2004 | Fujiwara | 399/303 |
| 2005/0095041 | A1 * | 5/2005 | Kim et al. | 399/302 |
| 2006/0100046 | A1 * | 5/2006 | Fuse | |
| 2007/0003319 | A1 * | 1/2007 | Nakaya | 399/303 |
| 2007/0019999 | A1 * | 1/2007 | Park | 399/302 |
| 2007/0041754 | A1 * | 2/2007 | Hachisuga et al. | 399/302 |
| 2007/0048014 | A1 * | 3/2007 | Mori | 399/165 |
| 2008/0205944 | A1 * | 8/2008 | Lee et al. | 399/302 |
| 2008/0247780 | A1 * | 10/2008 | Hara | 399/162 |

FOREIGN PATENT DOCUMENTS

| | | | |
|---|---|---|---|
| JP | 08099706 | A * | 4/1996 |
| JP | 11-327322 | | 11/1999 |
| JP | 2000289822 | A * | 10/2000 |
| JP | 2000289823 | A * | 10/2000 |
| JP | 2001-328745 | | 11/2001 |
| JP | 2002-167021 | | 6/2002 |
| JP | 2004-125961 | | 4/2004 |
| JP | 2005316257 | A * | 11/2005 |
| JP | 2006106270 | A * | 4/2006 |
| JP | 2006-119473 | | 5/2006 |
| JP | 2007145510 | A * | 6/2007 |

* cited by examiner

*Primary Examiner*—Susan S Lee
(74) *Attorney, Agent, or Firm*—Rabin & Berdo, PC

(57) ABSTRACT

A belt is entrained on a plurality of rollers and runs when the rollers are driven to rotate. A bead is attached to the belt and prevents the belt-like member from running crooked. The bead includes a first layer formed of a first material having a first hardness and a second layer formed of a second material having a second hardness. The second layer is laminated on the first layer. The bead is attached to the belt with the first layer being closer to the belt than the second layer. The first material and the second material expand simultaneously with temperature and humidity, and the first material and the second material contract simultaneously with temperature and humidity. The first hardness is higher than the second hardness.

7 Claims, 10 Drawing Sheets

FIG.7A

MATERIAL OF BEAD : URETHANE

| SPECIMEN | HARDNESS OF LAYERS | DIFFERANCE IN HARDNESS | APPEARANCE OF BELT AFTER ENVIRONMENT TEST | DAMAGE TO BELT DUE TO REPETITIVE BENDING | SOILING | INTERPRETATION OF RESULTS |
|---|---|---|---|---|---|---|
| 1 | 95 / 90 | 5 | OK | CRACK AFTER | ○ | × |
| 2 | 95 / 85 | 10 | OK | CRACK AFTER | ○ | × |
| 3 | 95 / 80 | 15 | OK | CRACK AFTER | ○ | × |
| 4 | 95 / 75 | 20 | OK | NO DAMAGE UP TO 100K PAGES | ○ | ○ |
| 5 | 95 / 70 | 25 | OK | NO DAMAGE UP TO 100K PAGES | ○ | ○ |
| 6 | 95 / 65 | 30 | OK | DETATCHMENT OF SECOND LAYER AFTER 25K PAGES | — | × |
| 7 | 95 / 60 | 35 | OK | DETATCHMENT OF SECOND LAYER AFTER 18K PAGES | — | × |
| 8 | 90 / 85 | 5 | OK | CRACK AFTER 50K PAGES | ○ | × |
| 9 | 90 / 80 | 10 | OK | CRACK AFTER 62K PAGES | ○ | × |
| 10 | 90 / 75 | 15 | OK | NO DAMAGE UP TO 100K PAGES | ○ | ○ |
| 11 | 90 / 70 | 20 | OK | NO DAMAGE UP TO 100K PAGES | ○ | ○ |
| 12 | 90 / 65 | 25 | OK | NO DAMAGE UP TO 100K PAGES | ○ | ○ |
| 13 | 90 / 60 | 30 | OK | DETATCHMENT OF SECOND LAYER AFTER 20K PAGES | — | × |
| 14 | 85 / 80 | 5 | OK | CRACK AFTER 75K PAGES | ○ | × |

FIG.7B

MATERIAL OF BEAD : URETHANE

| SPECIMEN | HARDNESS OF LAYERS | DIFFERANCE IN HARDNESS | APPEARANCE OF BELT AFTER ENVIRONMENT TEST | DAMAGE TO BELT DUE TO REPETITIVE BENDING | SOILING | INTERPRETATION OF RESULTS |
|---|---|---|---|---|---|---|
| 15 | 85 / 75 | 10 | OK | NO DAMAGE UP TO 100K PAGES | ○ | ○ |
| 16 | 85 / 70 | 15 | OK | NO DAMAGE UP TO 100K PAGES | ○ | ○ |
| 17 | 85 / 65 | 20 | OK | NO DAMAGE UP TO 100K PAGES | ○ | ○ |
| 18 | 85 / 60 | 25 | OK | BEAD WORN OUT | ○ | × |
| 19 | 80 / 75 | 5 | DETATCHMENT OF BEAD | — | — | × |
| 20 | 80 / 70 | 10 | ↓ | — | — | × |
| 21 | 80 / 65 | 15 | ↓ | — | — | × |
| 22 | 80 / 60 | 20 | ↓ | — | — | × |
| 23 | 75 / 70 | 5 | ↓ | — | — | × |
| 24 | 75 / 65 | 10 | ↓ | — | — | × |
| 25 | 75 / 60 | 15 | ↓ | — | — | × |
| 26 | 70 / 65 | 5 | ↓ | — | — | × |
| 27 | 70 / 60 | 10 | ↓ | — | — | × |
| 28 | 65 / 60 | 5 | DETATCHMENT OF BEAD | — | — | × |

FIG.10

MATERIAL OF ENDLESS BELT : PAI

| SPECIMEN | FIRST LAYER / SECOND LAYER | ENVIRONMENT TEST | | | CONTINUOUS PRINTING TEST | INTERPRETATION OF RESULTS |
|---|---|---|---|---|---|---|
| | | CHANGE IN DIMENSION (BELT) % | CHANGE IN DIMENSION (BEAD) % | WAVY SURFACE OF BELT | SOILING | |
| 1 | PET / URETHANE | 0.01 | 0.15 | YES | YES | × |
| 2 | PET / URETHANE | 0.01 | 0.15 | YES | YES | × |
| 3 | PET / URETHANE | 0.01 | 0.15 | YES | YES | × |
| 4 | URETHANE / URETHANE | 0.01 | 0.10 | YES | YES | × |
| 5 | URETHANE / URETHANE | 0.01 | 0.10 | YES | YES | × |
| 6 | URETHANE / URETHANE | 0.01 | 0.10 | YES | YES | × |
| 7 | PET / URETHANE | 0.007 | 0.15 | YES | YES | × |
| 8 | PET / URETHANE | 0.007 | 0.15 | YES | YES | × |
| 9 | PET / URETHANE | 0.007 | 0.15 | YES | YES | × |
| 10 | URETHANE / URETHANE | 0.007 | 0.10 | NO | NO | ○ |
| 11 | URETHANE / URETHANE | 0.007 | 0.10 | NO | NO | ○ |
| 12 | URETHANE / URETHANE | 0.007 | 0.10 | NO | NO | ○ |
| 13 | PET / URETHANE | 0.005 | 0.15 | YES | YES | × |
| 14 | PET / URETHANE | 0.005 | 0.15 | YES | YES | × |
| 15 | PET / URETHANE | 0.005 | 0.15 | YES | YES | × |
| 16 | URETHANE / URETHANE | 0.005 | 0.10 | NO | NO | ○ |
| 17 | URETHANE / URETHANE | 0.005 | 0.10 | NO | NO | ○ |
| 18 | URETHANE / URETHANE | 0.005 | 0.10 | NO | NO | ○ |

FIG.12

MATERIAL OF BEAD : URETHANE

| SPECIMEN | ADDITIVE TO SECOND LAYER | FRICTION COEFFICIENT OF SECOND LAYER | APPEARANCE OF BELT AFTER ENVIRONMENT TEST | DAMAGE TO BELT DUE TO REPETITIVE BENDING | SOILING | INTERPRETATION OF RESULTS |
|---|---|---|---|---|---|---|
| 1 | NO ADDITIVE | 1.8 | OK | CRACK AFTER 20K PAGES | ○ | × |
| 2 | FLUOROPLASTIC | 0.5 | OK | NO DAMAGE UP TO 100K PAGES | ○ | ○ |
| 3 | SILICONE RESIN | 0.7 | OK | NO DAMAGE UP TO 100K PAGES | ○ | ○ |

ENDLESS BELT HAVING DEFORMATION PREVENTION QUALITIES, AND IMAGE FORMING APPARATUS THAT USES THE ENDLESS BELT

BACKGROUND OF THE INVENTION

1. Field of the Invention

The present invention relates to an endless belt and an image forming apparatus that employs the endless belt, and more particularly to the structure of an endless belt.

2. Description of the Related Art

Among conventional belts is a semi-conductive endless belt having a bead that prevents the belt from running crooked or deviating from a desired straight travel path. The bead is formed of a base material (e.g., urethane) and a reinforcing material (e.g., polyethylene terephthalate (PET)) that are laminated one over the other. The bead is bonded to the endless belt using an adhesive.

The aforementioned endless belt suffers from a problem in that the dimensions of the belt and bead change due to changes in environmental conditions such as temperature and humidity. The changes in environmental conditions cause the belt to warp or to become wavy over time. Warping of the belt is detrimental to the performance of the belt, causing difficulty in maintaining long term print quality.

SUMMARY OF THE INVENTION

The present invention was made in view of the aforementioned drawbacks of a conventional belt body.

An object of the invention is to provide a belt body and an image forming apparatus capable of maintaining long term print quality.

Another object of the invention is to provide a belt body capable of transporting a print medium and maintaining good print quality irrespective of changes in temperature and humidity and changes of the belt body over time.

A belt is entrained on a plurality of supporting members and runs when the supporting members are driven. The belt includes a belt-like member and a guide member. The guide member prevents the belt-like member from running crooked. The guide member includes a first layer formed of a first material having a first hardness and a second layer formed of a second material having a second hardness. The second layer is laminated on the first layer. The guide member is attached to the belt-like member with the first layer being closer to the belt-like member than the second layer.

The first material and the second material expand simultaneously with temperature and humidity, and the first material and the second material contract simultaneously with temperature and humidity The first hardness is higher than the second hardness.

When the belt is left for 96 hours in an atmosphere of 70° C. and 90% RH, the belt-like member changes in dimension by a percentage of not more than 0.007% and the guide member changes in dimension by a percentage of not more than 0.1%.

The first material is a rubber having a first rubber hardness in a range of 85° to 95° (Japanese Industrial standards, JIS A) and the second material is a rubber having a second rubber hardness in a range of 65° to 75° (JIS A). The difference between the first rubber hardness and the second rubber hardness is in a range of 10° to 25°.

The guide member contains a friction-reducing material.

The belt-like member is either an endless belt or a non-endless belt.

An image forming apparatus includes the aforementioned belt. The belt is an endless belt. The image forming apparatus includes an endless belt entrained on at least two rollers. The endless belt carries a print medium or a visible image thereon. The visible image has been developed with a developer material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIGS. 7A and 7B illustrate the results of an environment test and a continuous printing test of a second embodiment;

FIG. 10 shows the results of the environment test and continuous printing test of a third embodiment;

FIG. 12 shows the results of the environment test and continuous printing test of a fourth embodiment.

DETAILED DESCRIPTION OF THE INVENTION

First Embodiment

Figure 1:
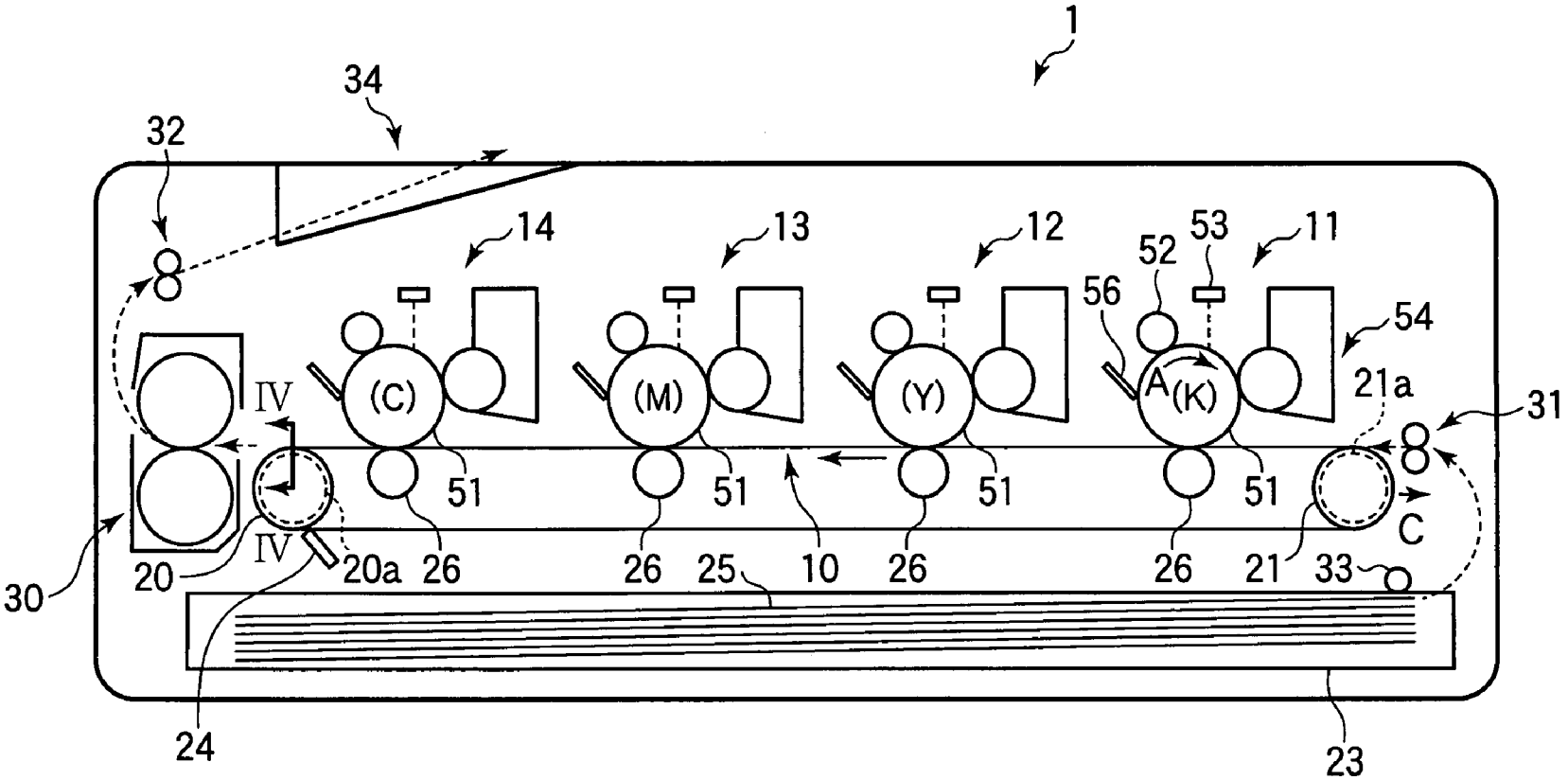
FIG. 1 is a general side view of an image forming apparatus of a first embodiment.

FIG. 1 is a general side view of an image forming apparatus 1 of a first embodiment that employs a belt body of the invention.

Referring to FIG. 1, the image forming apparatus 1 is a tandem type electrophotographic color printer. A paper cassette 23 holds a stack of print paper 25 therein. A feed roller 33 feeds a top page of the stack of print paper 25 from the paper cassette 23 into a transport path. A transport roller 31 transports the print paper 25 to an image forming section 11. Image forming sections 11-14 are aligned along the transport path from upstream to downstream to form black (K), yellow (Y), magenta (M) and cyan (C) images, respectively. The image forming sections 11-14 are of the same configuration and differ only in the color of the toner image.

For the image forming section 11, a charging section 52 charges the surface of a photoconductive drum 51. An exposing section 53 illuminates the charged surface of the photoconductive drum 51 in accordance with print data to form an electrostatic latent image. A developing section 54 supplies toner to the photoconductive drum 51 to develop the electrostatic latent image with the toner into a toner image. A cleaning blade cleans the residual toner from the photoconductive drum 51.

A belt 10 is entrained about a drive roller 20 and a tension roller 21, and is run to transport the print paper 25 thereon. Residual toner is cleaned by a cleaning blade 24 from the belt 10. A transfer roller 26 parallels the photoconductive drum 51 and transfers the toner image formed on the photoconductive drum 51 onto the print paper 25.

A fixing section 30 fixes the toner image on the print paper 25 by heat and pressure into a permanent image. A transport roller 32 discharges the print paper 25 onto a stacker 34 after fixing.

As described later, the drive roller 20 and tension roller 21 include pulleys 20*a* and 21*b*, respectively, secured to their one ends. The pulleys guide the bead 100 (FIG. 2) of belt 10, thereby preventing the belt 10 from running crooked.

The operation of the image forming apparatus 1 with the aforementioned configuration will be described with reference to FIG. 1. Dotted lines with arrows indicate the direction in which the print paper 25 is transported.

A power supply (not shown) applies a high voltage to the corresponding charging section 52, which in turn charges the surface of the photoconductive drum 51. When the photoconductive drum 51 rotates in a direction shown by arrow A, the charged surface passes under the exposing section 53. The exposing section 53 illuminates the charged surface of the photoconductive drum 51 to form an electrostatic latent image. The electrostatic latent image is developed by the developing section 54 into a toner image.

The feed roller 33 feeds a top page of the stack of print paper 25 held in the paper cassette 23 into the transport path. The print paper 25 is further fed by the registration roller 33 into the image forming section 11 in timed relation with image formation on the photoconductive drum 51. As the print paper 25 passes through a transfer point defined between the photoconductive drum 51 and the transfer roller 26, the toner image is transferred onto the print paper 25 by the electric field across the photoconductive drum 51 and the transfer roller 26. As the print paper 25 passes through the image forming sections 11-14 black (K), yellow (Y), magenta (M) and cyan (C) toner images are transferred one over the other in sequence, thereby forming a full color toner image on the print paper 25.

Subsequently, the print paper 25 is transported by the belt 10 to the fixing section 30 where the full color toner image is fused by heat and pressure into a permanent image. The print paper 25 is then discharged by the transport roller 32 onto the stacker 34. This completes the printing operation. The residual toner and foreign mater are cleaned by the cleaning blade 24 from the belt 10.

The belt 10 will be described in detail.

Figure 2:
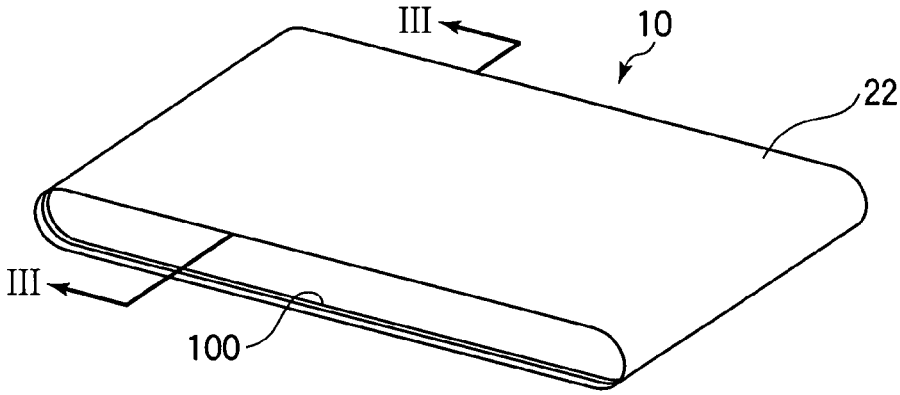
FIG. 2 is a perspective view of a belt of the invention.
Figure 3:
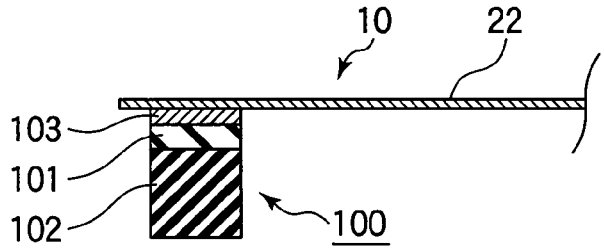
FIG. 3 is a partial cross-sectional view of the belt taken along a line III-III of FIG. 2.
Figure 4:
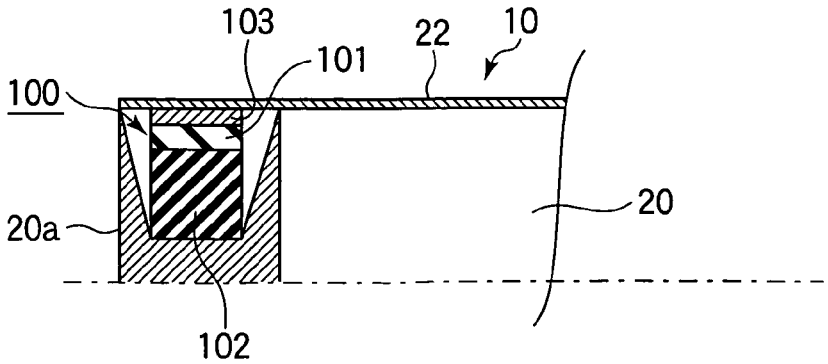
FIG. 4 is a partial cross-sectional view of a drive roller and a pulley taken along a line IV-IV of FIG. 1.

FIG. 2 is a perspective view of the belt 10. FIG. 3 is a partial cross-sectional view of the belt 10 taken along a line III-III of FIG. 2. FIG. 4 is a partial cross-sectional view of the drive roller 20 and pulley 20*a* taken along a line IV-IV of FIG. 1.

Referring to FIG. 2, the belt 10 includes an endless belt 22 and a bead 100 formed on an inner surface of the endless belt 22 at one widthwise end portion. Referring to FIG. 3, the bead 100 is a three-layer structure: a bonding agent layer 103, a first layer 101, and a second layer 102. The belt is mounted to the drive roller 20 and tension roller 21 such that the bead 100 is fittingly received in the annular grooves formed in the pulleys 20*a* and 21*a*.

The endless belt 22 is looped on the drive roller 20 and tension roller 21 under a tension of 6±0.6 kg.

The endless belt 22 was prepared as follows: Polyamide-imide (PAI) is mixed with an amount of carbon black for imparting electrical conductivity. The mixture is then stirred in a solution of N-methyl-2-pyrrolidone (NMP). Then, the mixture is molded by using a rotational molding, thereby forming a belt body having a thickness of 100±10 μm and a diameter of 226 mm. This belt body is cut into a belt having a width of 344.5±0.5 mm.

PAI has a series of a chemical structure in which an amide group is linked to one or two imide groups are via an organic group. PAI is either aliphatic PAI or aromatic PAI depending on whether the organic group is fatty acid series aromatic series. The belt 22 may be preferably formed of aromatic series PAI from a point of view of durability and mechanical characteristics. The aromatic series used in the present invention is such that an organic group linking an imide group to an amide group takes the form of one or two benzene rings. PAI may be an imide ring-closure or amide acid before imide ring-closure. If PAI contains amide acid, at least more than 50%, preferably more than 70%, of the PAI should be imide ring-closure. This is because incorporation of a large percentage of amide acid causes large dimension errors.

From points of view of durability and mechanical characteristics, it is usually required of the material for the belt 10 that deformation due to tension is within a predetermined range when the belt is driven to run, and that damage to the belt due to repetitive bending is minimum. The material for the belt 10 is not limited to the aforementioned PAI. Any material may be used provided that the aforementioned requirements are fulfilled. For example, materials having a Young's modulus of larger than 2000 MPa, preferably larger than 3000 MPa, may be used. Such materials include polyimide (PI), polycarbonate (PC), polyimide (PA), polyaryletheretherketone (PEEK), polyvinylidene fluoride (PVdF), ethylene tetrafluoroethylene (ETFE), and mixtures based on these resins.

When the belt 10 is manufactured by using a rotational molding, the solvent may be selected as appropriate. An organic solvent is commonly used. Useful solvents include N, N-dimethylformamides, N,N-dimethylacetamides, N,N-diethylformamide, N,N-diethylacetamides, Dimethyl sulfoxide, NMP, pyridine, tetramethylene sulfone, and dimethyltetramethylene sulfone. N,N-dimethylacetamides is particularly useful. These solvents may be used alone or in combination. The aforementioned solvents may also be used when the belt is made with a cylindrical mold. No solvent is required for a belt manufactured by an extrusion molding method.

Carbon black in a proper amount added to the belt material includes furnace black, channel black, ketjen black, and acetylene black. These materials may be used alone or in combination. Any of these materials may be employed depending on the required electrical conductivity. In the present invention, furnace black and channel black are preferably used for the endless belt of the invention. Furnace black and channel black may be preferably undergone anti-oxidant treatment such as oxidation treatment or may preferably have improved dispersion into the solvent. The amount of carbon black may be selected depending on the types of carbon black for specific purpose. The endless belt of the invention contains carbon black in an amount of 3-40 wt % and more preferably 3-30 wt % for sufficient mechanical strength.

The materials for the first layer 101 and the second layer preferably have rubber elasticity and may be any material as long as the material does not denature in the image forming apparatus. Such materials include polyurethane rubber, polychloroprene, silicone rubber, natural rubber, butadiene rubber, and nitrile rubber (NBR). These materials may be used alone or in combination. Polyurethane rubber is especially preferred in terms of wear-resistance, contamination-resistance, and mechanical strength. The specific configuration of the bead material will be described later based on testing and testing results.

The bead 100 is bonded to the endless belt 22 by the bonding agent layer 103. The bonding agent layer 103 may preferably an elastic adhesive from points of view of peeling force and shear force exerted on the endless belt 22 and the bead 100, and the stability of adhering force with changes in temperature and humidity. The elastic adhesive is effective in accommodating differences in the change of dimensions between the endless belt 22 and the bead 100.

Printing was performed using various specimens of belt 10 formed of different materials. The test results will be described in detail. The printing was performed using an image forming apparatus with substantially the same configuration as that shown in FIG. 1.

The first layer 101 is formed of polyethylene terephthalate (PET) and has a thickness of 100 μm. The second layer 102 is formed of urethane having a thickness of 900 μm and a hardness of 65° (JIS A). If both the first and second layers 101 and 102 are formed of urethane, the first layer 101 has a thickness of 200 μm and a hardness of 90° (JIS A) and the second layer 102 has a thickness of 800 μm and a hardness of 65° (JIS A). The hardness will be described later.

The toner used in the image forming apparatus 1 contains paraffin wax in an amount of 9 weight parts based on 100 weight parts of styrene acrylic copolymer. The paraffin wax is internally added to the toner by emulsion polymerization method. The toner particles have an average diameter of 7 μm and a sphericity of 0.95. This toner does not require a toner release agent and is excellent in transfer efficiency, dots reproducibility, and resolution of printed images, providing sharp images and high quality images.

The cleaning blade 24 (FIG. 1) is formed of urethane rubber and has a rubber hardness of 83° (JIS A) and a thickness of 1.5 mm. The cleaning blade 24 applies a line pressure of 4.3 g/mm on the belt 10. A blade formed of an elastic material such as urethane rubber is excellent in removing residual toner and foreign matter from the belt 10, and is of simple structure, which implements a compact, low cost blade. Urethane is employed for its high hardness, elasticity, wear-resistance, mechanical strength, oil-resistance, and ozone-resistance. Ozone-resistance prevents deterioration of urethane.

The drive roller 20 and tension roller 21 have a diameter of 25 mm. However, the diameter is not limited to 25 mm. Actually, a diameter in the range of 10 to 50 mm is commonly employed for implementing a low cost and small size image forming apparatus.

The endless belt 22 is looped on the drive roller 20 and tension roller 21. The tension roller 21 is urged by an urging means, e.g., spring (not shown) in a direction shown by arrow C. The tension is 6±0.6 kg. However, the belt may be looped on the rollers 20 and 21 in different ways. The tension may be selected depending on the material of the belt and a belt driving means, and is usually in the range of 1.8-8.8 kg.

A plurality of belts 10 were prepared in which the endless belt 22 is formed of PAI and the first and second layers 101 and 102 are formed of urethane having different hardnesses. The results of environment test and continuous printing tests will be described.

Tests were performed under the following conditions.

The belt 10 is incorporated in the belt unit for the MODEL ML 9600 OKI printer. The belt unit was in an environment of, for example, 23±3° C. and 55±10% RH for 24 hours before it is left for 96 hours in an atmosphere of 70° C. and 55±90% RH.

Figure 5:
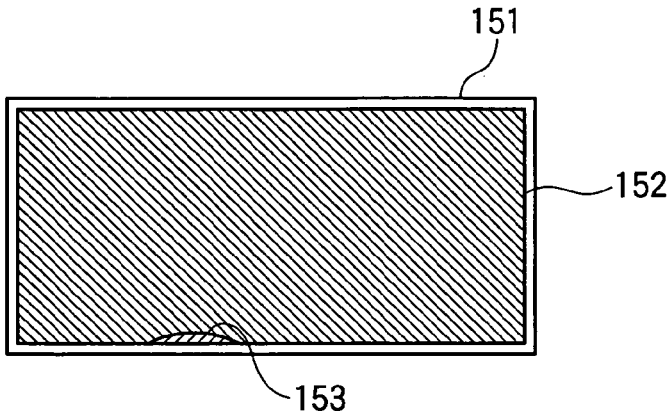
FIG. 5 illustrates a print medium and its printable area.

FIG. 5 illustrates a print medium and its printable area.

The continuous printing test was performed under the following conditions after the environment test. A printing pattern of a black image having a density of 50% was printed on A3 size paper. The printing pattern was printed on the entire printable area 152 shown in FIG. 5. Continuous printing of 20 pages was performed a plurality of times until a total of 100,000 pages were printed. Inspection was made for print defects 153 (soiling shown in FIG. 5). If a print defect exists on at least one page, then that continuous printing was considered to have failed.

A plurality of beads 100 having different hardnesses were prepared, the beads 100 having different combinations of the hardness of the first and second layers. Then, the beads 100 were bonded to the endless belt 22 having a change in dimension of 0.007%, thereby preparing a plurality of specimens of belt 10. Then, using the specimens of belts 10, the aforementioned environment test and continuous printing test were conducted.

Figure 6:
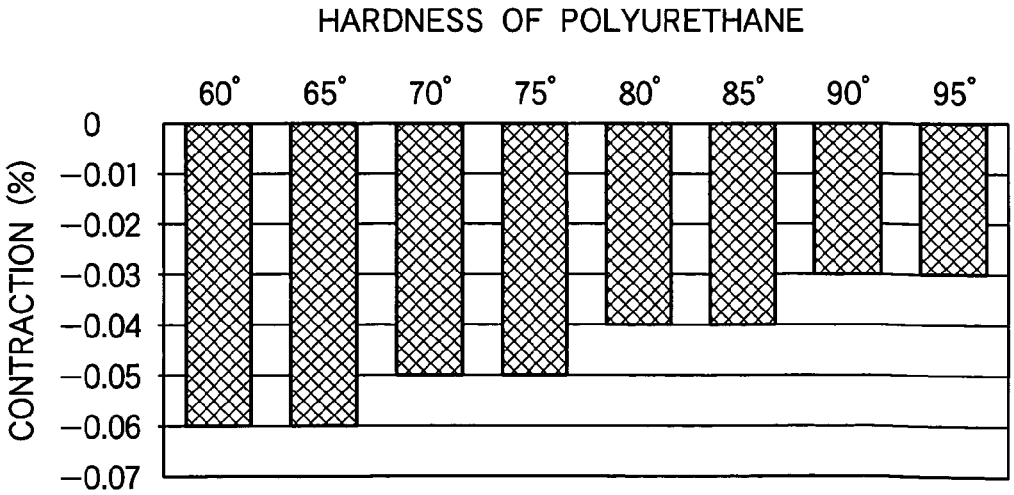
FIG. 6 illustrates the contraction of test specimens formed of polyurethane having various hardnesses.

FIG. 6 illustrates the shrinkage or contraction of test specimens formed of polyurethane having hardness in the range of 60-95° (JISA) after having been left for 96 hours in an environment of 70° C. and 90% RH. The specimens had been stored in an atmosphere of 23±3° C. and 55±10% RH for 24 hours before they were placed in an environment of 70° C. and 90% RH. Negative values of shrinkage or contraction imply that the test specimens actually expanded.

FIGS. 7A and 7B shows the results of the environment test and continuous printing test. Symbol "○" in "Interpretation of results" indicates that no abnormal appearance of the belt 10 after environment test, no damage to the belt due to repetitive bending during printing, and no soiling were observed. Symbol "X" in "Interpretation of results" indicates that at least one of abnormal appearance of belt after environment test, damage to the belt due to repetitive bending during printing, and soiling was observed. The hardness of a bead is represented by, for example, "95/90", which means that the first layer 101 (urethane) has a rubber hardness of 95° (JIS A) and the second layer 102 (urethane) has a rubber hardness of 90° (JIS A). Symbol "-" indicates that none of abnormal appearance of belt after environment test, damage to the belt due to repetitive bending during printing, and soiling was acceptable.

The results in FIGS. 7A and 7B reveal that the belt should meet following requirements. The first layer 101 has a rubber hardness preferably in the range of 85 to 95° (JIS A). The second layer 102 has a rubber hardness preferably in the range of 65 to 75° (JIS A). The difference in hardness between the first layer 101 and the second layer 102 is preferably in the range of 10 to 25°.

For example, if a bead is a single layer, a bead formed of a material having a low hardness is not capable of preventing crooked running of the belt, and a bead formed of a material having a high hardness is difficult to sufficiently wrap around the pulley. For this reason, the hardness of the first layer 101 is selected to be higher than that of the second layer 102, so that the bead 100 may be bonded to the endless belt 22 without strain. If the hardness of the first layer 101 is low, the bead 100 is partially stretched during the bonding operation, so that the adhesion at a joint between the longitudinal ends of the bead widely varies, causing the bead 100 to detach from the endless belt 22. Thus, the gap between the longitudinal ends of the bead may vary widely.

When the belt 10 wraps around the drive roller 20 and the tension roller 21, the second layer 102 is subjected to the highest compression. It is required of the second layer 102 that the second layer 102 is capable of being inflected easily with least stress when the second layer 102 is subject to strain. Too high a hardness in combination with the high hardness of the endless belt 22 causes the hardness of the bead 100 to increase. Therefore, repetitive inflection of the belt 10 when the belt 10 passes around the drive roller 20 and tension roller 21 causes stress to be concentrated on the surface of the endless belt 22 in contact with the bead 100. This tends to cause a tear in the belt 10. On the other hand, too low a hardness causes the bead 100 to greatly deform under an external force, leading to crooked running of the belt 10. Too low a hardness of the bead causes the friction of the bead 100 against a guide member, shortening the life of the belt 10.

Too large a difference in hardness between the first layer 101 and the second layer 102 causes the first and second layers to detach from one another due to repetitive inflection of the belt 10 when the belt 10 passes around the drive roller 20 and tension roller 21.

While the first embodiment has been described in terms of the first and second layers formed of urethane, the first and second layers are preferably designed such that both the first and second layers expand or both the first and second layers contract.

As described above, the hardness of the first and second layers of the bead and the difference in hardness between the first and second layers are selected appropriately, ensuring stable transport of the print paper and print quality over time regardless of changes in environmental conditions.

Second Embodiment

A belt 10 of a second embodiment includes an endless belt 22 having a change in dimension in a predetermined range and a bead having a change in dimension in a predetermined range.

The environment test and continuous printing test of the second embodiment are conducted using the same image forming apparatus as in the first embodiment. The second embodiment will be described in terms of configuration and test procedure different from those for the first embodiment.

A plurality of specimens of belts 10 were prepared in which endless belts 22 have different changes in dimension and beads have different configurations and changes in dimension. Environment test and continuous printing were conducted using the specimens under the following test conditions.

Figure 8:
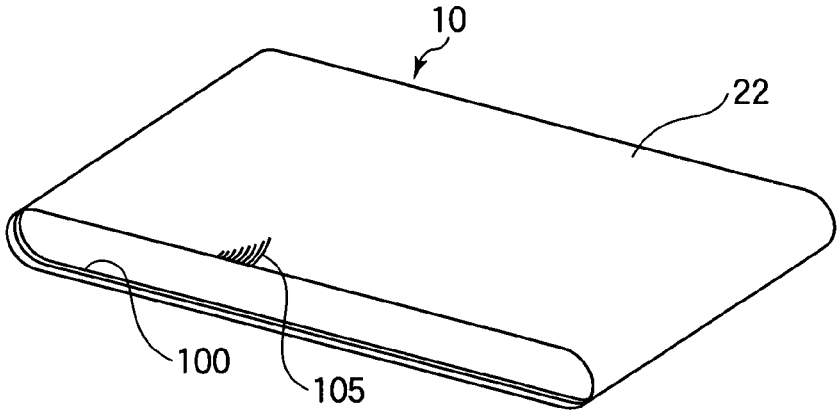
FIG. 8 illustrates a belt and wavy surface on the belt of the second embodiment.

FIG. 8 illustrates a wavy surface 105 on the belt after an environment test. The belt unit for the MODEL ML9600 OKI printer was used in the environment test. The belt 10 was incorporated in the belt unit, and was then left for 24 hours in an atmosphere of, for example, 23±3° C. and 55±10% RH prior to the environment test. Then, the belt unit was left for 90 hours in an atmosphere of, for example, 70° C. and 90±10% RH. Then, inspection was made for any wavy surface 105 as shown in FIG. 8. Continuous printing was performed after the environment test to print a black pattern having a density of 50% on the entire printable area 152 of A3 size print paper 151 (FIG. 5). Continuous printing of 20 pages was performed only once. If a print defect was found on at least one page, then that continuous printing was considered to have failed and denoted by symbol "X".

Figure 9:
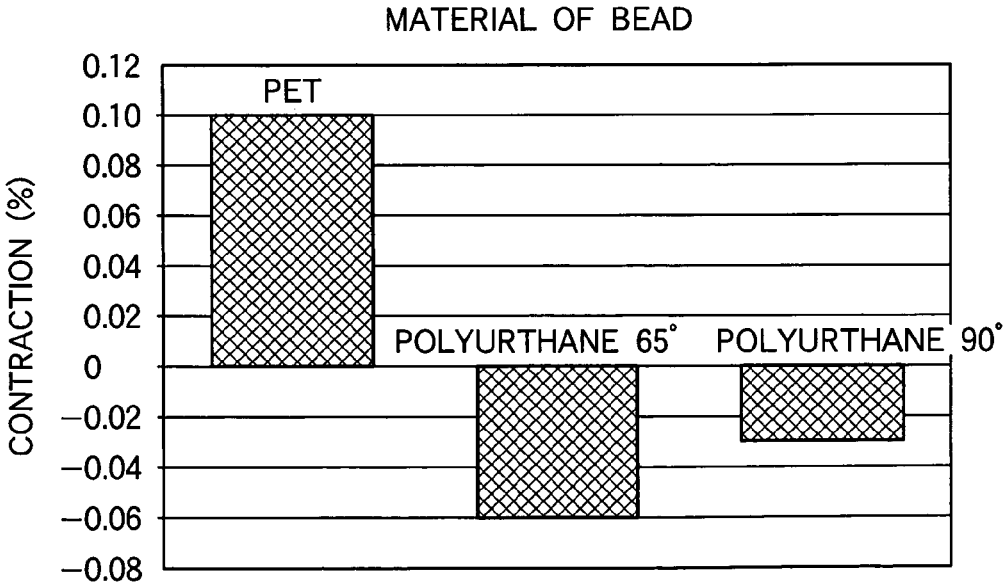
FIG. 9 is a graph representing the shrinkage of various materials.

FIG. 9 is a graph representing the shrinkage or contraction of PET, polyurethane having a hardness of 65° (JIS A),and polyurethane having a hardness of 90° (JIS A). The specimens were left for 24 hours in an environment of, for example, 23±3° C. and 55±10% RH, and then the specimens were left for 96 hours in an atmosphere of 70° C. and 90±10% RH. Negative values of shrinkage imply that the belts 10 were actually stretched. It is to be noted that PET contracts while polyurethane expands.

FIG. 10 shows the results of the environment test and continuous printing test.

FIG. 10 lists changes in dimension under three different values of volumetric humidity: 10° C./43%, 30° C./65%, and 40° C./90%. The inner circumferential lengths of the endless belts 22 were measured before the beads were bonded to the endless belts. The change in the dimension of belt after the endless belts were undergone the three different values of volumetric humidity was calculated by using the following equation.

$$\text{Change in dimension} = \frac{L1 - L2}{L2} \times 100$$

where L1 is an inner circumferential length of the belt after the environment test and L2 is an inner length of the belt before the environment test.

The beads were first stored for 24 hours in an atmosphere of 23±3° C. and 55±10% RH. The beads were then left for 96 hours in an atmosphere of 70° C. and 90% RH. The change in the dimension of bead per unit volumetric humidity was calculated by using the following equation.

$$\text{Change in dimension} = \frac{L3 - L4}{L4} \times 100$$

where L3 is an inner circumferential length of the bead after the environment test and L4 is an inner length of the bead before the environment test.

FIG. 10 also lists changes in the dimension of beads. The beads were tested before they were bonded to the endless belt. A laminated structure of the first and second layers gives rise to strain inside the bead. Therefore, the changes in dimension are larger than the changes in dimension of the first layer alone or the second layer alone.

Referring to FIG. 10, symbol "○" in "Interpretation of results" indicates that no wavy surface is detectable on the belt 10 after the environment test, and that no soiling was observed after the environment test. Symbol "X" in "Interpretation of results" indicates that at least one of abnormal appearance (wavy surface) of the belt 10 and soiling was observed after the environment test. The configuration of the bead is described by, for example, "PET/urethane", which means that the first layer 101 is formed of PET and the second layer 102 is formed of urethane. The first layer 101 has a thickness of 200 μm. The second layer 102 has a thickness of 800 μm.

The results shown in FIG. 10 reveal that the changes in dimension for the endless belt is preferably not more than 0.007% and that the change in dimension for the bead is preferably not more than 0.1%.

A large change in dimension causes the endless belt 22 to expand or contract depending on ambient temperature and humidity. A tensile force acts on a portion of the endless belt wrapping around the drive roller 20 and tension roller 21, and a compressive force acts on the bead bonded to the inner surface of the endless belt 22. The tensile force and compressive force together with the expansion and shrinkage (contraction) tend to cause the belt 10 to become wavy.

Figure 11:
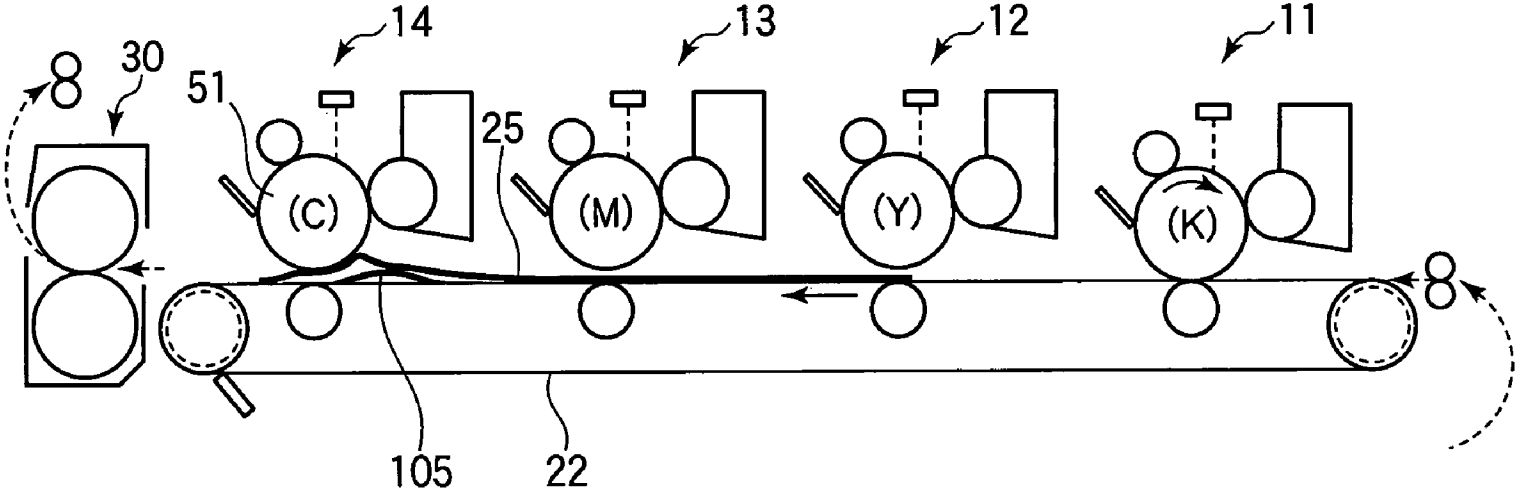
FIG. 11 illustrates an example of an image forming apparatus configured such that the photoconductive drums of the image forming sections are lifted up during monochrome printing.

FIG. 11 illustrates an example of an image forming apparatus configured such that the photoconductive drums of the image forming sections are lifted up during monochrome printing.

Some image forming apparatuses are configured such that the photoconductive drums 51 of the image forming sections 12-14 are lifted up during monochrome printing. If the belt 10 becomes wavy, then the print medium 25 electrostatically attracted on the belt 10 may not be in intimate contact with the belt surface. If the belt 10 is highly wavy, the print medium 25 may rub the surface of the photoconductive drum 25 to cause soiling of print medium.

When the first layer 101 of the bead 100 is formed of PET, the belt 10 is apt to become wavy for the following reasons.

When a PET film is formed, a tensile stress acts on the PET laminated on urethane, thereby causing strain in the PET. The strain results in stress inside the PET film. The stress may be alleviated over time or due to the changes in environmental conditions (e.g., temperature and humidity). This causes contraction of the PET film. This tendency is prominent if the bead is molded in a shorter time for lower manufacturing cost. Serious waves of the belt 10 causes the bead to raise from the endless belt 22. If the wavy belt 10 is used, the bead will detach from the endless belt 22.

The smaller the variations of dimension of the belt 10 are, the better the performance of the belt unit is. However, a belt formed of an inorganic compound (e.g., the belt 10 of the invention) is not entirely free from dimensional variations over time or due to the changes in environmental conditions. It is extremely difficult to make the belt formed of an inorganic compound completely free from dimensional variations over time and the changes in environmental conditions. The belt of the invention is looped on the drive roller 20 and tension roller 21. Thus, a tensile force acts on the outer surface of the endless belt wrapping around the drive roller 20 and tension roller 21 and a compressive force acts on the inner surface of the endless belt 22 wrapping around the drive roller 20 and tension roller 21. If the belt 10 is completely free from the changes in the dimensions over time and the changes in the dimensions due to the changes in environmental conditions, the internally acting stress increases due to repetitive inflection, eventually being cracked soon. Thus, the change in dimension varying for belt greater than zero should be accepted.

Generally speaking, it is extremely difficult to accurately measure the length of a resilient member such as a bead. Therefore, the change in dimension for bead is preferably greater than zero taking measurement errors and the aforementioned reasons into account.

As described above, both the endless belt 22 and the bead 100 are allowed to change to some extent, and have positive changes in dimension for bead or negative changes in dimension for bead. This is important because a combination of a negative value for the endless belt 22 and a positive value for the bead 100 or vice versa causes a large relative change in dimension between the endless belt 22 and the bead 100.

Consequently, it is preferable that an endless belt 22 having a change in dimension in the range of 0.001-0.007% is combined with a bead having a change in dimension in the range of 0.01-0.1%.

As described above, an endless belt having a change in dimension in a predetermined range is combined with a bead having a change in dimension in a predetermined range, thereby ensuring high quality printing and reliable transport of the print paper over time regardless of changes in environmental conditions.

Third Embodiment

An image forming apparatus of a third embodiment employs a belt 10 in which a bead 100 contains a friction reducing agent.

Environment test and continuous printing test of the second embodiment are conducted using the same image forming apparatus as in the first embodiment. The second embodiment will be described in terms of configuration and test procedure different from those in the first embodiment.

Fluoroplastic and silicone resin are said to reduce friction. The bead 100 of the third embodiment includes a second layer 102 that contains Fluoroplastic or silicone resin. A plurality of specimens of the belt 10 were prepared for environment test and continuous printing test. The bead 100 includes a first layer 101 formed of urethane having a hardness of 90° (JIS A) and a second layer 102 formed of urethane having a hardness of 70° (JIS A).

The results were evaluated as follows:

The belt unit for the MODEL ML9600 OKI printer was used in the environment test. Then, the belt unit was left for 96 hours in an atmosphere of, for example, 70° C. and 90% RH. Then, inspection was made.

After the environment test, continuous printing was performed under the following conditions. A black pattern having a density of 50% was printed on the entire printable area 152 of A3 size print paper 151 (FIG. 5). Continuous printing of 20 pages was performed. If a print defect (soiling) was found on at least one page, then that continuous printing was considered to have failed and indicated by symbol "X".

Two specimens of beads 100 (FIG. 3) were prepared which contains different friction-reducing materials in the second layer 102. The beads 100 were bonded to endless belts having a change in dimension of 0.007%, respectively. Another specimen was prepared which does not contain a friction-reducing material in the second layer 102. Using these three types of belt were subjected to environment test and continuous printing test. The beads were distorted intentionally such that the bead is easy to run over the guide. Specifically, the image forming apparatus was tilted during the continuous printing test.

FIG. 12 shows the results of the environment test and continuous printing test. Symbol "○" in "Interpretation of results" indicates that no abnormal appearance of belt after environment test, no damage to the belt due to repetitive bending, and no soiling were observed. Symbol "X" in "interpretation of results" indicates that at least one of abnormal appearance of belt after environment test, defects (belt damage to the belt due to repetitive bending, and soiling was observed.

The results shown in FIG. 12 reveal that adding a friction-reducing material to the second layer 102 minimizes the occurrence of damage to the belt.

The test results may be interpreted as follows:

The belt 10 is looped on the drive roller 20. A description will be given of the belt when is runs crooked. When the belt 10 runs crooked, the larger the friction coefficient of the second layer 102 is, the more the bead 100 tends to climb over a guide groove formed in the pulley 20*a*. For this reason, a friction-reducing material (fluoroplastic or silicone resin) is added to the second layer 102, thereby reducing a friction force that would otherwise cause the bead 100 to climb over the guide.

A friction-reducing material may be added to urethane when the second layer 102 and the first layer 101 are laminated one over the other. This implies that the belt does not require a manufacturing process for bonding or coating the friction-reducing material.

As described above, adding a friction-reducing material to the second layer of the bead reduces the friction coefficient of the second layer to minimize the force that would act on the belt to cause the belt to run crooked, thereby ensuring stable transport of the print paper and good print quality.

Fourth Embodiment

Figure 13:
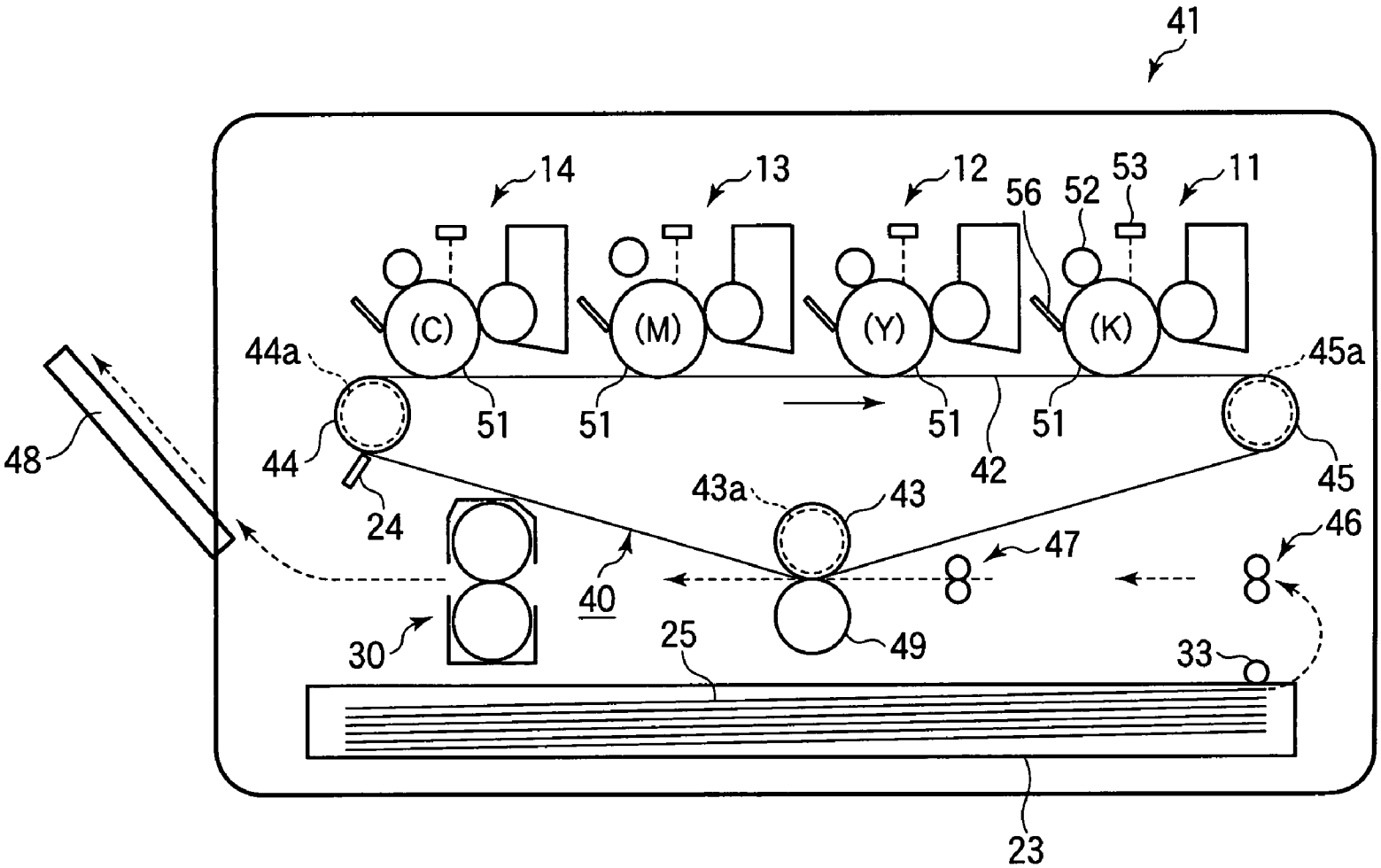
FIG. 13 illustrates the general configuration of a pertinent portion of an image forming apparatus of the fourth embodiment.

FIG. 13 illustrates the general configuration of a pertinent portion of an image forming apparatus 41 of a fourth embodiment.

The image forming apparatus 41 is an intermediate transfer type image forming apparatus as opposed to the direct transfer type image forming apparatus 1 of the first embodiment. Elements of the image forming apparatus 41 similar to those of the image forming apparatus 1 have been given the same reference numerals and their description is omitted. A description will be given of portions different from those of the image forming apparatus 1.

Referring to FIG. 13, the image forming apparatus 41 is color a color electrophotographic printer that includes a paper cassette 23, a feed roller 33, and transport rollers 46 and 47. The paper cassette 23 holds a stack of print medium 25 therein. The feed roller 33 picks up a top page of the stack of print medium 25 from the paper cassette 23. The transport rollers 46 and 47 transports the print medium 25 to a transfer point defined between a transfer roller 49 and a support roller 43. Image forming sections 11-14 are aligned from upstream to downstream with respect to a direction in which a belt 40 runs, and form cyan (C), magenta (M), yellow (Y), and black (K) images, respectively. Photoconductive drums of the respective image forming sections 11-14 are in contact with the belt 40. The image forming sections 11-14 are of the same configuration and differ only in color. The image forming sections 11-14 are of the same configuration as those of the first embodiment, and therefore, the description of their configuration is omitted.

The image forming apparatus 41 includes a belt unit. The belt unit includes a belt 40 as an intermediate transfer member. The support rollers 43-45 are driven in rotation by a drive source (not shown). A cleaning blade 24 scrapes residual toner off the belt 10. A transfer roller 49 parallels the support roller 43 such that the belt 10 is sandwiched between the support roller 43 and the transfer roller 49. When the print medium 25 passes through a transfer point defined between the belt 10 and the transfer roller 49, a toner image is transferred onto the print medium 25.

The belt 40 includes an endless belt 42 (FIG. 13) and a bead 100 (FIG. 3). Pulleys 43*a*-45*a* are secured to the support rollers 43-45 just as the pulleys 20*a* of the first embodiment, guiding the bead 100 to run normally. The structure, mounting position, and operation of the pulleys 43*a*-45*a* are the same as those of the pulleys 20*a* and their detailed description is omitted.

The operation of the image forming apparatus 41 of the aforementioned configuration will be described. Dotted arrows shown in FIG. 13 indicate the direction of travel of the print medium 25.

Electrostatic latent images of the respective colors are formed on the surfaces of the photoconductive drums 51 of the image forming sections 11-14, and are developed with toners of the respective colors into toner images. When the belt 40 passes through the transfer points, the toner images of the respective colors are transferred onto the belt 40 one over the other into a full color toner image.

The feed roller 33 feeds a top page of the stack of print medium 25 from the paper cassette 23. The transport rollers 46 and 47 transport the print medium 25 to the transfer point defined between the transfer roller 49 and the belt 40. As the print medium 25 passes through the transfer point, the full color toner image is transferred onto the print medium 25.

The print medium 25 having the full color toner image thereon is transported by a transport means (not shown) to a fixing unit 30. The toner image on the print medium is fixed by heat and pressure into a permanent full color image. Then, the print medium 25 is discharged onto a stacker. The belt 40 is cleaned of the residual toner and foreign matter by the cleaning blade 24.

The image forming apparatus 41 may employ a belt having the same characteristics and configuration as any one of the first, second, and third embodiments.

For example, the first layer 101 may formed of urethane having a rubber hardness preferably in the range of 85 to 95° (JIS A). The second layer 102 is formed of urethane having a rubber hardness preferably in the range of 65 to 75° (JIS A). The difference in hardness between the first layer 101 and the second layer 102 is preferably in the range of 10 to 25°.

An endless belt having a change in dimension in the range of 0.001-0.007% may be preferably combined with a bead having a change in dimension in the range of 0.01-0.1%.

The second layer 102 preferably may contain a friction-reducing material for a smaller friction coefficient.

The use of the endless belt 42 and bead 100 of the first to third examples offers the same effects and advantages as the first to third embodiments.

While the first to fourth embodiments have been described in terms of a belt in which a bead is provided on the inner surface of the endless belt only at one widthwise end portion, the bead may also be provided at both widthwise end portions. The endless belts of the first to fourth embodiments may be replaced by non-endless belts.

Although the first to fourth embodiments have been described in terms of an electrophotogrpahic printer, the present invention may also be applied to a multi function printer (MFP), a facsimile machine, and a copying machine. While the embodiments have been described with respect to an image forming apparatus that operates in a simplex printing mode, the present invention may also be applied to an image forming apparatus that operates in a duplex printing mode.

What is claimed is:

1. A belt entrained on a plurality of supporting members and running when the supporting members are driven, comprising:

a belt-like member; and a guide member that prevents the belt-like member from running crooked, the guide member including a first layer formed of a first material having a first hardness and a second layer formed of a second material having a second hardness, the second layer being laminated on the first layer, the guide member being attached to the belt-like member with the first layer being closer to the belt-like member than the second layer;

wherein when the belt is left for 96 hours in an atmosphere of 70° C. and 90% RH, the belt-like member changes in dimension by a percentage of not more than 0.007% and the guide member changes in dimension by a percentage of not more than 0.1%.

2. The belt according to claim 1, wherein the first material and the second material expand simultaneously with temperature and humidity, and the first material and the second material contract simultaneously with temperature and humidity.

3. The belt according to claim 1, wherein the first hardness is higher than the second hardness.

4. The belt according to claim 3, wherein the first material is a rubber having a first rubber hardness in a range of 85° to 95° (JIS A) and the second material is a rubber having a second rubber hardness in a range of 65° to 75° (JIS A), wherein a difference between the first rubber hardness and the second rubber hardness is in a range of 10° to 25°.

5. The belt according to claim 1, wherein the guide member contains a friction-reducing material.

6. The belt according to claim 1, wherein the belt-like member is either an endless belt or a non-endless belt.

7. An image forming apparatus comprising a belt according to claim 1, wherein the belt is an endless belt entrained on at least two rollers, the endless belt carrying a print medium or a visible image thereon, the visible image having been developed with a developer material.

* * * * *